US007985076B2

(12) United States Patent
Zuinen et al.

(10) Patent No.: US 7,985,076 B2
(45) Date of Patent: Jul. 26, 2011

(54) RECEPTACLE FOR COAXIAL CONNECTOR

(75) Inventors: Takao Zuinen, Nagaokakyo (JP); Makoto Kitamura, Nagaokakyo (JP); Naoaki Fujino, Nagaokakyo (JP); Katsumi Kohnishi, Nagaokakyo (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 12/910,648

(22) Filed: Oct. 22, 2010

(65) Prior Publication Data

US 2011/0097930 A1 Apr. 28, 2011

Related U.S. Application Data

(63) Continuation of application No. PCT/JP2009/055924, filed on Mar. 25, 2009.

(30) Foreign Application Priority Data

Apr. 23, 2008 (JP) ..... 2008-112713

(51) Int. Cl.
*H01R 12/00* (2006.01)

(52) U.S. Cl. ..... 439/63

(58) Field of Classification Search ..... 439/63, 439/581, 881, 582, 578
See application file for complete search history.

(56) References Cited

U.S. PATENT DOCUMENTS 6,739,907 B2 * 5/2004 Kuroda et al. ..... 439/582
7,648,394 B2 * 1/2010 Yotsutani ..... 439/581
7,699,652 B2 * 4/2010 Yotsutani ..... 439/581
7,753,690 B2 * 7/2010 Maruyama et al. ..... 439/63

FOREIGN PATENT DOCUMENTS

JP 8-288021 A 11/1996
JP 2002-198137 A 7/2002
JP 2004-221055 A 8/2004

OTHER PUBLICATIONS

International Search Report; PCT/JP2009/055924; Apr. 21, 2009.

* cited by examiner

*Primary Examiner* — Jean F Duverne
(74) *Attorney, Agent, or Firm* — Studebaker & Brackett PC; Tim L. Brackett, Jr.

(57) ABSTRACT

A receptacle for coaxial connector includes an outer conductor having a tubular portion, a central conductor having a central-conductor contact portion extending in an axis direction in an internal space of the tubular portion, and an insulator holding the outer conductor and the central conductor in an insulating state. An overhanging region made of the outer conductor and the insulator overhangs in a direction perpendicular to the tubular portion of the outer conductor. In this overhanging region, the outer conductor includes outer-conductor overhanging portions, and the insulator includes an insulator overhanging portion. The outer-conductor overhanging portions and the insulator overhanging portion have substantially the same thickness.

13 Claims, 4 Drawing Sheets

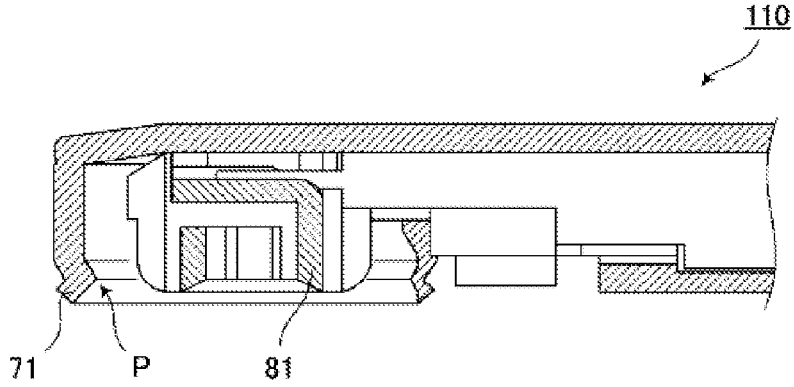
FIG. 2A
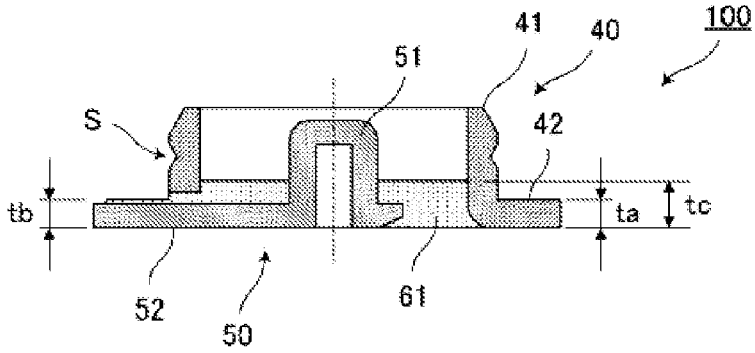
FIG. 2B
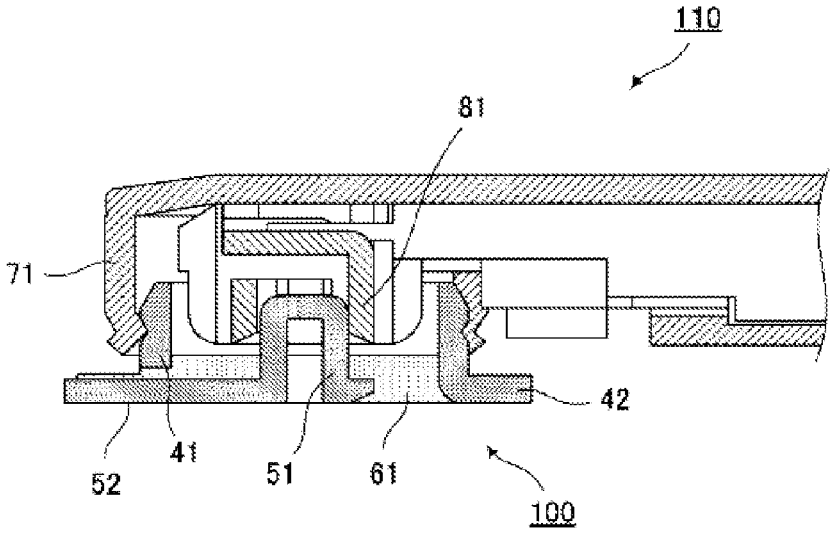

RECEPTACLE FOR COAXIAL CONNECTOR

CROSS-REFERENCE TO RELATED APPLICATIONS

The present application is a continuation of International Application No. PCT/JP2009/055924 filed Mar. 25, 2009, which claims priority to Japanese Patent Application No. 2008-112713 filed Apr. 23, 2008, the entire contents of each of these applications being incorporated herein by reference in their entirety.

TECHNICAL FIELD

This invention relates to electrical connectors, and more particularly, to a receptacle for coaxial connector.

BACKGROUND

As a receptacle for coaxial connector used for transmission of a high-frequency signal, for example, Japanese Unexamined Patent Publication No. 2004-221055 (Patent Document 1) is disclosed. A structure thereof is described, based on FIG. 1.

This receptacle for coaxial connector 1 has an external conductor 10 having a cylindrical portion, and a central conductor 20 including a contact portion extending in an axis line direction in an internal space of the cylindrical portion, and is structured so as to integrally hold both the external conductor 10 and the central conductor 20 through a molded dielectric body (insulator) 30 in a lower section between both the conductors 10 and 20.

A lock groove 13 as a stopper of a plug is formed in the cylindrical portion of the external conductor 10. Further, in order to prevent the central conductor 20 from coming off from the dielectric body (insulator) 30 in a back surface direction by a stress at the time of plug attachment, a surface worked portion (recessed portion) 22A is provided in an inward end portion of the central conductor 20.

In a structure described in Patent Document 1, a resin is molded so as to cover an upper portion of the external conductor, and thus, a thickness of the external conductor and a thickness of the resin are accumulated, which increases outer dimensions of the product. Further, a position of the lock groove 13 provided in the cylindrical portion of the external conductor as the stopper of the plug becomes higher by the accumulated thickness of the resin, which also increases a whole height in a state where the plug is attached to the receptacle.

Furthermore, there is a problem that a distance between the lock groove 13 of the cylindrical portion of the external conductor 10 and an upper surface of the dielectric body (insulator) 30, which is a height needed to attach the plug, cannot be ensured.

SUMMARY

In an embodiment consistent with the claimed invention, a receptacle for coaxial connector includes an outer conductor having a tubular portion, a central conductor having a contact portion extending in an axis direction in an internal space of the tubular portion of the outer conductor, and an insulator holding the outer conductor and the central conductor in an insulating state. An overhanging region made of the outer conductor and the insulator overhangs in a surface direction perpendicular to the tubular portion of the outer conductor.

The outer conductor has an outer-conductor overhanging portion, which is arranged in the overhanging region and overhangs outward from a bottom of the tubular portion in the surface direction perpendicular to the axis direction of the tubular portion except for a predetermined section.

The central conductor has a central-conductor drawing portion, which is arranged in the predetermined section inside the overhanging region and is drawn out in a direction perpendicular to the axis direction of the tubular portion.

The insulator has an insulator overhanging portion, which is arranged in the predetermined section inside the overhanging region and partially covers the central-conductor drawing portion.

A thickness of the outer-conductor overhanging portion and a thickness of the insulator overhanging portion are substantially the same.

The foregoing configuration can make it unnecessary to form a layer of the insulator on an upper surface of the outer conductor, which can ensure a distance from an upper surface of the insulator layer to a lock groove of a cylindrical portion. This distance is a height can be needed to attach a plug, so that the receptacle for coaxial connector can be made small and short in height while ensuring reliability.

According to a more specific exemplary embodiment, a cross-sectional shape of border portions between the insulator overhanging portion and the central-conductor drawing portion may be a shape that allows the central-conductor drawing portion to be locked toward a bottom surface direction of the insulator overhanging portion.

According to yet another more specific embodiment, a cross-sectional shape of border portions between the outer-conductor overhanging portion and the insulator overhanging portion may be a shape that allows the insulator to be locked toward a bottom surface direction from the outer-conductor overhanging portion.

The cross-sectional shapes locking the insulator and the central-conductor drawing portion and/or the outer-conductor overhanging portion can increase integration strength of the outer conductor and/or the central conductor with the insulator, and can prevent the outer conductor and/or the central conductor from coming off from the insulator.

In other more specific exemplary embodiments, the cross-sectional shape of the border portions between the insulator overhanging portion and the outer-conductor overhanging portion, and/or between the insulator overhanging portion and the central-conductor drawing portion may have at least one step portion.

In other more specific exemplary embodiments, border portions between the insulator overhanging portion and the outer-conductor overhanging portion, and/or border portions between the insulator overhanging portion and the central-conductor drawing portion can include a tapered cross-sectional shape.

Use of step or taper shapes can further increase the integration strength of the outer conductor and the central conductor with the insulator, and can prevent the outer conductor and the central conductor from coming off from the insulator.

BRIEF DESCRIPTION OF THE DRAWINGS

FIG. 2A is a cross-sectional view of a receptacle for coaxial connector and a plug for coaxial connector according to a first exemplary embodiment in an unattached state.

FIG. 2B is a cross-sectional view of the receptacle for coaxial connector and the plug for coaxial connector shown in FIG. 2A in an attached state.

DETAILED DESCRIPTION

Figure 1A:
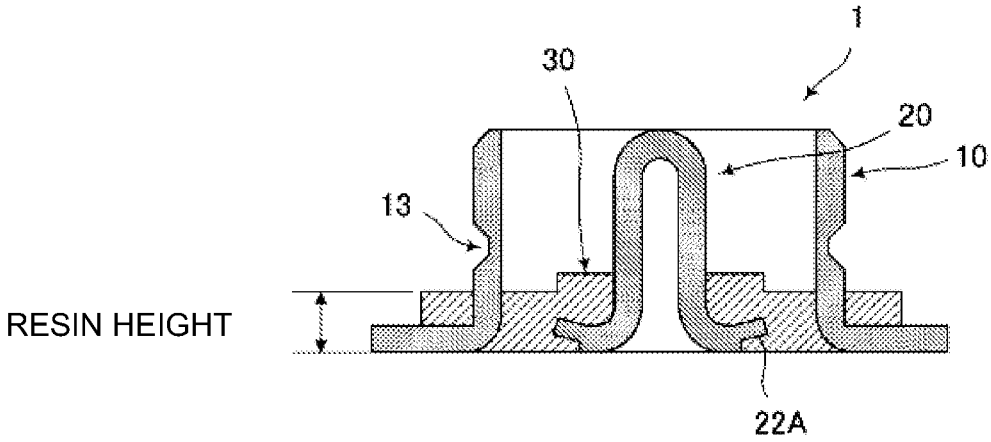
FIG. 1A Prior Art
FIGS. 1A and 1B are cross-sectional views of a receptacle for coaxial connector described in Patent Document 1.

A configuration of a receptacle for coaxial connector according to a first embodiment is described with reference to FIGS. 2A to 4.

FIGS. 2A and 2B are cross-sectional views of a receptacle for coaxial connector (hereinafter, simply referred to as a receptacle) 100 and a plug for coaxial connector (hereinafter, simply referred to as a plug) 110 to be attached to or detached from the same. FIG. 2A shows a state where both the receptacle 100 and plug 110 are separated, and FIG. 2B shows a state where they are attached.

The receptacle 100 includes an outer conductor 40 having a tubular portion 41, a central conductor 50 having a central-conductor contact portion 51 extending in an axis direction of the tubular portion 41 (shown as an alternating long and short dash line) in an internal space of the tubular portion 41 of the outer conductor 40, and an insulator 61 holding the outer conductor 40 and the central conductor 50 in an insulating state.

The central conductor 50 includes a central-conductor drawing portion 52, which is drawn out in a direction perpendicular to the axis direction of the tubular portion of the outer conductor 40. Moreover, the outer conductor 40 includes an outer-conductor overhanging portion 42, which overhangs outward from a bottom of the tubular portion 41 in directions perpendicular to the axis direction of the tubular portion 41 of the outer conductor 40 except for (so as to avoid) a position through which the central-conductor drawing portion 52 passes.

As will be described later, an overhanging region extending in the perpendicular directions from the tubular portion 41 of the outer conductor 40 includes a region where an insulator overhanging portion of the insulator 61 exists, and a region where the outer-conductor overhanging portions 42 exists when seen in a thickness direction. A thickness dimension tb of the insulator overhanging portion and a thickness dimension to of the outer-conductor overhanging portion 42 are almost or substantially the same.

Also, a thickness dimension of a section of the central-conductor drawing portion 52 including a thickness of the insulator is the same or substantially the same as the thickness dimension tb of the insulator overhanging portion.

The plug 110 includes an outer conductor 71 and an inner conductor 81, and in the state where the plug 110 is attached to the receptacle 100 as shown in FIG. 2B, the outer conductor 71 of the plug 110 comes into contact with the tubular portion 41 of the outer conductor 40 of the receptacle 100, and the inner conductor 81 of the plug 110 comes into contact with the central-conductor contact portion 51 of the central conductor of the receptacle 100.

As shown in FIG. 2A, a groove S is formed in an outer circumferential surface of the tubular portion 41 of the outer conductor 40, and a protruded portion P is formed in an inner circumferential surface of the outer conductor 71 of the plug 110, respectively, so that the groove S and protruding portion P can be engaged.

In this manner, since the thickness dimension of the insulator 61 is almost equal to the thickness dimensions of the outer-conductor overhanging portion 42 and the section of the central-conductor drawing portion 52, a distance between a lower end surface of the outer conductor 71 of the plug 110, and upper surfaces of the outer-conductor overhanging portion 42 and the section of the central-conductor drawing portion 52 of the receptacle 100 can be sufficiently ensured.

Figure 3B:
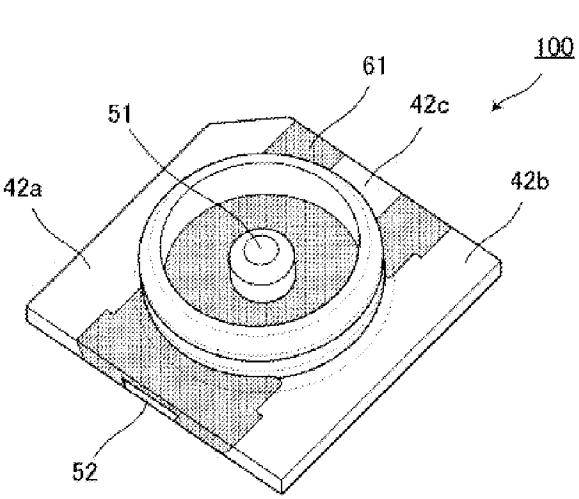
FIG. 3B is a perspective view of the whole receptacle according to the first exemplary embodiment.
Figure 3C:
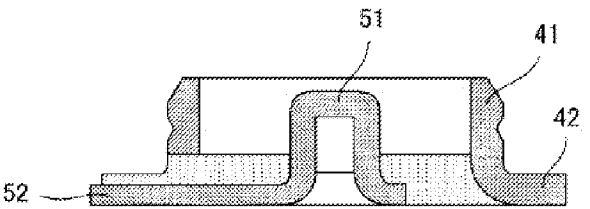
FIG. 3C is a cross-sectional view of the receptacle shown in FIG. 3B, going through a center in a longitudinal direction of the central conductor.
Figure 3A:
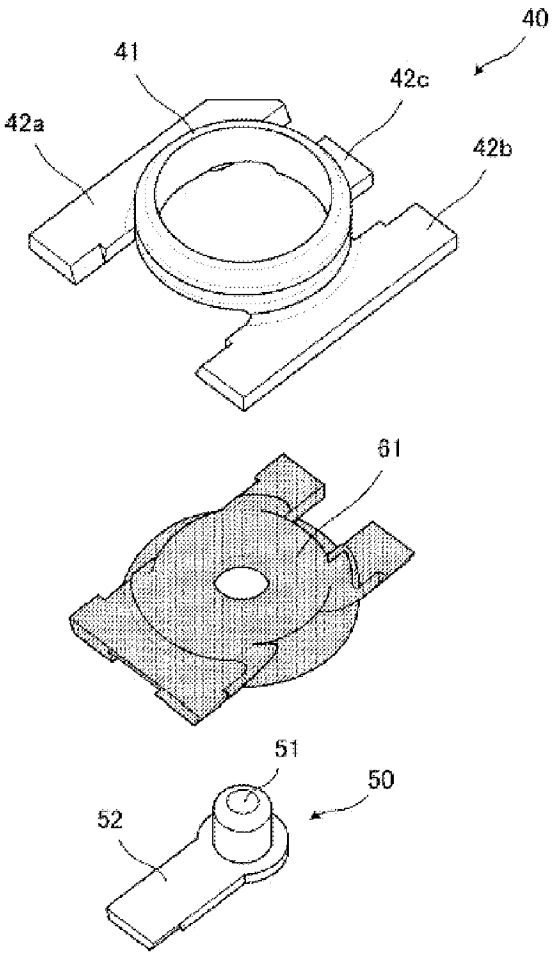
FIG. 3A is an exploded perspective view of an exemplary configuration of the receptacle acccording to the first exemplary embodiment.

FIGS. 3A to 3C are views showing a configuration of the receptacle, where FIG. 3A is an exploded perspective view of the receptacle, FIG. 3B is a perspective view of the whole receptacle 100, and FIG. 3C is a cross-sectional side view of the receptacle 100, going through a center of the receptacle in a longitudinal direction of the central conductor.

As shown in FIG. 3A, the outer conductor 40 includes the tubular portion 41, and outer-conductor overhanging portions 42*a*, 42*b* and 42*c* overhanging outward from the bottom of the tubular portion 41 in a surface direction perpendicular to the axis direction of this tubular portion 41. Moreover, the central conductor 50 includes the central-conductor contact portion 51 extending in the axis direction in the internal space of the tubular portion 41 of the outer conductor 40, and the central-conductor drawing portion 52, which is drawn out in the direction perpendicular to the axis direction of the tubular portion 41 of the outer conductor 40.

The outer-conductor overhanging portions 42*a*, 42*b*, 42*c* of the outer conductor 40 are formed except for (so as to avoid) the position through which the central-conductor drawing portion 52 passes.

The insulator 61 has a shape that holds the outer conductor 40 and the central conductor 50 in an insulating state by resin molding, and has the insulator overhanging portion in a region where the outer-conductor overhanging portions 42*a*, 42*b*, 42*c* do not exist. Moreover, the insulator overhanging portion partially covers the central conductor drawing portion 52.

As shown in FIG. 3B, the overhanging region (substantially square) extending in the perpendicular directions from the tubular portion 41 of the outer conductor 40 includes the region where only the insulator overhanging portion of the insulator 61 exists, and the region where only the outer-conductor overhanging portions 42*a*, 42*b*, 42*c* exist when seen in the thickness direction. That is, on the upper surfaces of the outer-conductor overhanging portions 42*a*, 42*b*, 42*c*, the insulator 61 is not arranged. Accordingly, the thickness of the insulating overhanging portion of the insulator 61 and the thickness of the outer-conductor overhanging portions 42*a*, 42*b*, 42*c* are almost, or substantially the same.

Figure 1B:
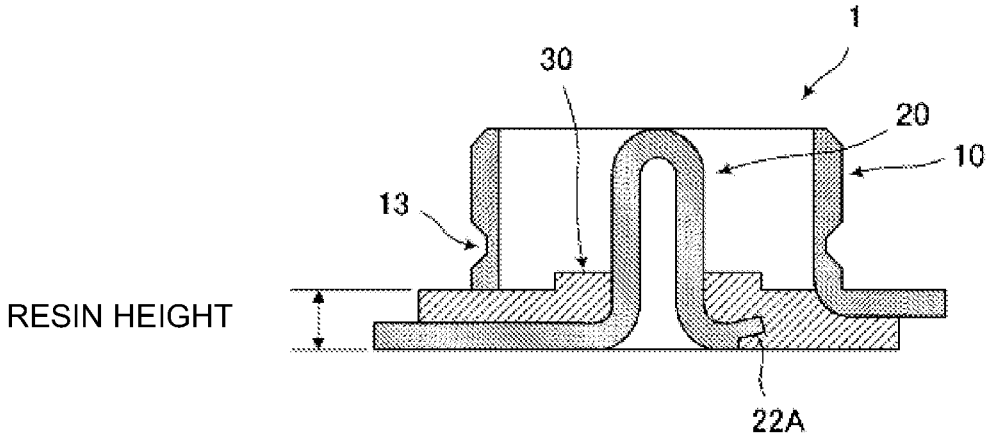
FIG. 1B Prior Art

The above-described structure can reduce a height from a bottom surface of the receptacle to the upper surface of the insulator overhanging portion, thereby decreasing the thickness of the overhanging region, which dominates the outer shape of the receptacle. For example, while in the conventional structure shown in FIGS. 1A and 1B, a height dimension of the receptacle is 0.27 mm, it can be reduced to 0.12 mm according to this exemplary embodiment. With this, the outer shape of the product can be made small and short in height.

Moreover, while the conventional structure requires forming a cavity by working in order to mold the resin on an upper surface of a terminal, embodiments consistent with the claimed invention simplify a shape of the insulator (resin), which can cut a manufacturing cost of a metal mold.

Furthermore, molding the resin on the upper surface of the terminal in the conventional structure results in complicated resin flow. By contrast, embodiments according to the claimed invention simplify the shape of the insulator (resin), which makes it difficult to cause defective molding (short shot) by entangled air or the like.

As shown in FIGS. 2A and 2B, a thickness dimension (tc) of the insulator 61 inside the outer-conductor tubular portion 41 is larger than the thickness dimension (tb) of the insulator 61 in a region outside the outer-conductor tubular portion 41. This increases integration strength of the insulator 61 and the central conductor 50.

Figure 4:
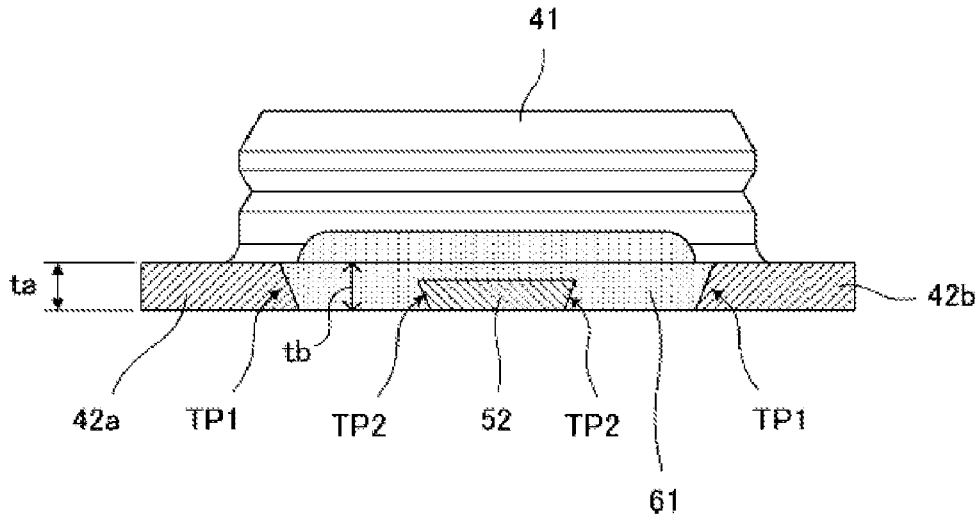
FIG. 4 is a front view when seen from a drawing direction of a central-conductor drawing portion of the receptacle according to the first exemplary embodiment.

FIG. 4 is a front view when seen from a drawing direction of the central-conductor drawing portion 52. As shown FIG. 4, there are provided taper portions TP1 in which a cross-sectional shape of border portions between the insulator 61 and the outer-conductor overhanging portions 42*a*, 42*b* is a shape tapered from the upper surfaces of the outer-conductor overhanging portions 42*a*, 42*b* to lower surfaces thereof. This shape is similar in a relationship between the outer-conductor overhanging portion 42*c* and the insulator 61 shown in FIGS. 3A to 3C.

Moreover, there are also provided taper portions TP2 in which a cross-sectional shape of border portions between the insulator 61 and the center-conductor drawing portion 52 is a shape tapered from a lower surface of the central-conductor drawing portion 52 to an upper surface thereof.

The above-described structure allows the central-conductor drawing portion 52 to be locked with the insulator 61, thereby preventing the central-conductor drawing portion 52 from coming off from the insulator 61 in a bottom surface direction. Similarly, the insulator 61 is locked with the outer-conductor overhanging portions 42*a*, 42*b*, thereby preventing the insulator 61 from coming off in the bottom surface direction. As similar locking effect is true of the outer-conductor overhanging portion 42*c* in the center.

The structure described above can prevent the central conductor 50 and the insulator 61 from coming off from the outer conductor 40 by the stress when the plug 110 shown in FIGS. 2A and 2B is attached.

End surfaces of the above-described outer-conductor overhanging portion 42 and the central-conductor drawing portion 52 can be formed by press molding such as coining process, swaging process, side force process and the like.

Accordingly, the outer conductor 40 and the central conductor 50 do not need to be formed into complicated shapes (embossed shapes) in order to prevent the central conductor from coming-off the insulator and the insulator from coming-off an external terminal at the time of plug insertion. Additionally, the end surfaces of the outer-conductor overhanging portion 42 and the central-conductor drawing portion 52 can be relatively easily formed by press molding such as the coining process, the swaging process, the side force process and the like.

Figure 5:
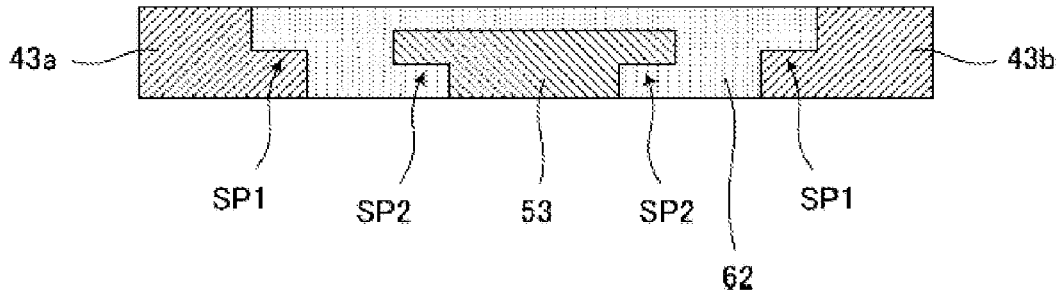
FIG. 5 is a cross-sectional view along a plane perpendicular to a drawing direction of a central-conductor drawing portion in an outer-conductor overhanging portion of a receptacle according to a second exemplary embodiment.

FIG. 5 is a cross-sectional view of a receptacle according to a second embodiment, which is taken along a plane perpendicular to a drawing direction of a central-conductor drawing portion in an outer-conductor overhanging portion. Different points from a receptacle according to the first exemplary embodiment are a cross-sectional shape of border portions between an insulator 62 and a central-conductor drawing portion 53, and a cross-sectional shape of border portions between outer-conductor overhanging portions 43*a*, 43*b* and the insulator 62. Other configurations of the second exemplary embodiment not shown (e.g., the tubular portion) are similar to those of the first exemplary embodiment.

In the example shown in FIG. 5, the cross-sectional shape of the central-conductor drawing portion 53 is set so as to include step portions SP2 in border surfaces between the insulator 62 and the central-conductor drawing portion 53. Moreover, the cross-sectional shape of the outer-conductor overhanging portions 43*a*, 43*b* is set so as to include step portions SP1 in border surfaces between the outer-conductor overhanging portions 43*a*, 43*b* and the insulator 62. This configuration is applied to another outer-conductor overhanging portion not shown in FIG. 5 (an outer-conductor overhanging portion corresponding to the outer-conductor overhanging portion 42*c* in the center shown in FIGS. 3A to 3C in the first exemplary embodiment).

In this manner, the provision of the step portions SP1, SP2 increases integration strength between the insulator 62 and the outer conductor and integration strength between the central conductor and the insulator 62.

Figure 6:
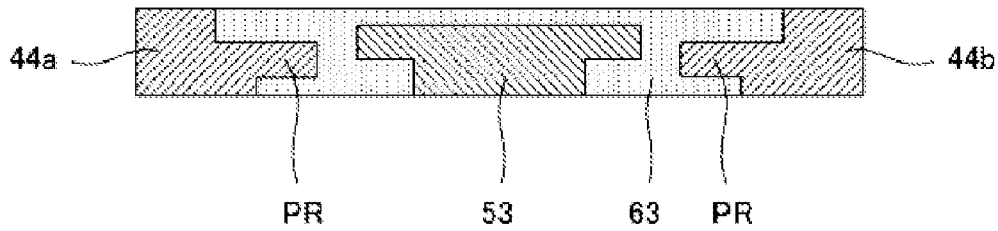
FIG. 6 is a cross-sectional view along a plane perpendicular to a drawing direction of a central-conductor drawing portion in an outer-conductor overhanging portion of a receptacle according to a third exemplary embodiment.

FIG. 6 is a cross-sectional view of a receptacle according to a third exemplary embodiment, which is taken along a plane perpendicular to a drawing direction of a central-conductor drawing portion in an outer-conductor overhanging portion. Different points from the receptacle according to the first exemplary embodiment are a cross-sectional shape of border portions between an insulator 63 and the central-conductor drawing portion 53, and a cross-sectional shape of border portions between outer-conductor overhanging portions 44*a*, 44*b* and the insulator 63. Other configurations of the third exemplary embodiment not shown are similar to those of the first embodiment.

As shown in FIG. 6, the cross-sectional shape of the outer-conductor overhanging portions 44*a*, 44*b* is set so as to include a plurality of step portions PR in each border surface between the outer-conductor overhanging portions 44*a*, 44*b* and the insulator 63. This configuration is applied to another outer-conductor overhanging portion not shown in FIG. 6 (outer-conductor overhanging portion corresponding to the outer-conductor overhanging portion 42*c* in the center shown in FIGS. 3A to 3C in the first exemplary embodiment).

The cross-sectional shape of border portions between the insulator 63 and the central-conductor drawing portion 53 can be similar to that of the second embodiment.

Providing the plurality of step portions PR in this manner further increases integration strength between the insulator 63 and the outer conductor 40.

For the above-described step portions, thin portions are formed by subjecting a metal plate to the coining process, and punching out unnecessary portions of the thin portions. Alternatively, the step portions may be formed by performing the punch-out process, and then flattening terminal end portions by the coining process or swaging process.

Embodiments of a receptacle for a coaxial connector consistent with the claimed invention can provide a construction that is small, short in height, and having a high mechanical strength.

Although a limited number of embodiments is described herein, one of ordinary skill in the art will readily recognize that there could be variations to any of these embodiments and those variations would be within the scope of the appended claims and their equivalents.

What is claimed is:

1. A receptacle for coaxial connector comprising:

an outer conductor having a tubular portion;

a central conductor having a contact portion extending in an axis direction in an internal space of the tubular portion of the outer conductor; and an insulator holding the outer conductor and the central conductor in an insulating state, wherein an overhanging region made of the outer conductor and the insulator overhangs in a surface direction perpendicular to the tubular portion of the outer conductor, the outer conductor includes an outer-conductor overhanging portion, which is arranged in the overhanging region and overhangs outward from a bottom of the tubular portion in the surface direction perpendicular to the axis direction of the tubular portion except for a predetermined section, the central conductor includes a central-conductor drawing portion, which is arranged in the predetermined section inside the overhanging region and is drawn out in a direction perpendicular to the axis direction of the tubular portion, the insulator includes an insulator overhanging portion, which is arranged in the predetermined section inside the overhanging region and partially covers the central-conductor drawing portion, and a thickness of the outer-conductor overhanging portion and a thickness of the insulator overhanging portion are substantially the same.

2. The receptacle for coaxial connector according to claim 1, wherein a cross-sectional shape of border portions between the insulator overhanging portion and the central-conductor drawing portion is a shape that allows the central-conductor drawing portion to be locked toward a bottom surface direction of the insulator overhanging portion.

3. The receptacle for coaxial connector according to claim 1, wherein a cross-sectional shape of border portions between the outer-conductor overhanging portion and the insulator overhanging portion is a shape that allows the insulator to be locked toward a bottom surface direction from the outer-conductor overhanging portion.

4. The receptacle for coaxial connector according to claim 2, wherein a cross-sectional shape of border portions between the outer-conductor overhanging portion and the insulator overhanging portion is a shape that allows the insulator to be locked toward a bottom surface direction from the outer-conductor overhanging portion.

5. The receptacle for coaxial connector according to claim 2, wherein the cross-sectional shape of the border portions between the insulator overhanging portion and the central-conductor drawing portion includes a step portion.

6. The receptacle for coaxial connector according to claim 2, wherein the cross-sectional shape of the border portions between the insulator overhanging portion and the central-conductor drawing portion includes a plurality of step portions.

7. The receptacle for coaxial connector according to claim 3, wherein the cross-sectional shape of the border portions between the outer-conductor overhanging portion and the insulator overhanging portion includes a step portion.

8. The receptacle for coaxial connector according to claim 3, wherein the cross-sectional shape of the border portions between the outer-conductor overhanging portion and the insulator overhanging portion includes a plurality of step portions.

9. The receptacle for coaxial connector according to claim 4, wherein the cross-sectional shape of at least one of the border portions between the insulator overhanging portion and the central-conductor drawing portion, and the border portions between the outer-conductor overhanging portion and the insulator overhanging portion includes a step portion.

10. The receptacle for coaxial connector according to claim 4, wherein the cross-sectional shape of at least one of the border portions between the insulator overhanging portion and the central-conductor drawing portion, and the border portions between the outer-conductor overhanging portion and the insulator overhanging portion includes a plurality of step portions.

11. The receptacle for coaxial connector according to claim 2, wherein the border portions between the insulator overhanging portion and the central-conductor drawing portion include a tapered cross-sectional shape.

12. The receptacle for coaxial connector according to claim 3, wherein the border portions between the outer-conductor overhanging portion and the insulator overhanging portion include a tapered cross-sectional shape.

13. The receptacle for coaxial connector according to claim 4, wherein at least one of the border portions between the insulator overhanging portion and the central-conductor drawing portion, and the border portions between the outer-conductor overhanging portion and the insulator overhanging portion include a tapered cross-sectional shape.

* * * * *